US009212852B2

(12) United States Patent
Hwang et al.

(10) Patent No.: US 9,212,852 B2
(45) Date of Patent: Dec. 15, 2015

(54) SUPPORT MECHANISM FOR A HEAT EXCHANGER IN AN AIR-CONDITIONING SYSTEM

(71) Applicant: LG ELECTRONICS INC., Seoul (KR)

(72) Inventors: Junhyeon Hwang, Seoul (KR); Hongseok Choi, Changwon-si (KR); Changhwan Cho, Changwon-si (KR)

(73) Assignee: LG ELECTRONICS INC., Seoul (KR)

( * ) Notice: Subject to any disclaimer, the term of this patent is extended or adjusted under 35 U.S.C. 154(b) by 297 days.

(21) Appl. No.: 13/887,728

(22) Filed: May 6, 2013

(65) Prior Publication Data

US 2014/0014300 A1 Jan. 16, 2014

(30) Foreign Application Priority Data

Jul. 11, 2012 (KR) ..... 10-2012-0075633

(51) Int. Cl.
*F28F 9/00* (2006.01)
*F28F 1/00* (2006.01)
*F28D 7/02* (2006.01)

(52) U.S. Cl.
CPC . *F28F 1/00* (2013.01); *F28D 7/024* (2013.01); *F28F 2280/06* (2013.01)

(58) Field of Classification Search
CPC ..... F22B 37/202; F28F 9/007; F28F 9/013; F28F 9/02; F28F 9/022; F28F 9/07; A01J 9/04; F24H 9/06; F28D 7/024
USPC ..... 248/56; 165/67, 68
See application file for complete search history.

(56) References Cited

U.S. PATENT DOCUMENTS 1,940,964 A * 12/1933 McIntyre ..... F28D 1/053 165/128
2,125,972 A * 8/1938 Wilson ..... F28F 9/26 165/143
2,534,690 A * 12/1950 Young, Jr. ..... F16L 3/227 248/68.1
2,761,430 A * 9/1956 Schaefer ..... 122/510

(Continued)

FOREIGN PATENT DOCUMENTS

DE 1 078 145 3/1960
DE 1 952 861 4/1971

(Continued)

OTHER PUBLICATIONS

Korean Office Action dated Aug. 30, 2013. (75633).

(Continued)

*Primary Examiner* — Marc Norman
*Assistant Examiner* — Devon Russell
(74) *Attorney, Agent, or Firm* — Ked & Associates LLP

(57) ABSTRACT

A heat exchanger is provided that may include a shell; a first pipe that guides a first fluid into the shell; a tube, through which a second fluid that exchanges heat with the first fluid may pass; a second pipe, through which the first fluid is guided outside of the shell; and a base including a fastening portion to which the shell may be fastened and a support portion that supports the fastening portion. The fastening portion may have a tube hole, through which the tube may pass, and a pipe hole, through which at least one of the first pipe or the second pipe may pass, so that it is possible to increase availability of space at a side of and above the shell, and at least one of the first pipe, the second pipe, or the tube may be protected by the base, resulting in high reliability.

19 Claims, 6 Drawing Sheets

(56) References Cited

U.S. PATENT DOCUMENTS

| | | | | |
|---|---|---|---|---|
| 3,199,583 | A | 8/1965 | Hood, Jr. et al. | |
| 3,341,122 | A | 9/1967 | Whittell, Jr., Alfred | |
| 3,817,688 | A * | 6/1974 | Shadley | 431/343 |
| 4,152,015 | A * | 5/1979 | Jones et al. | 285/123.8 |
| 4,202,406 | A | 5/1980 | Avery | |
| 4,471,836 | A | 9/1984 | Hokanson | 165/111 |
| 6,095,240 | A | 8/2000 | Hassanein et al. | |
| 6,463,757 | B1 * | 10/2002 | Dickson et al. | 62/503 |
| 7,458,222 | B2 | 12/2008 | Orr | |
| 7,549,462 | B2 | 6/2009 | Nuris et al. | |
| 2006/0005955 | A1 | 1/2006 | Orr | |
| 2009/0025399 | A1 * | 1/2009 | Kamen | B01D 1/02 62/6 |

FOREIGN PATENT DOCUMENTS

| | | | |
|---|---|---|---|
| DE | 1 679 733 | | 1/1972 |
| DE | 8715522 | U1 | 5/1988 |
| DE | 10 2007 002 051 | | 7/2007 |
| EP | 0 261 005 | | 3/1988 |
| EP | 0 819 892 | A2 | 1/1998 |
| EP | 0 845 640 | | 6/1998 |
| EP | 0 845 640 | A1 | 6/1998 |
| EP | 1 750 070 | | 2/2007 |
| EP | 1 813 882 | | 8/2007 |
| EP | 2 505 932 | A1 | 10/2012 |
| GB | 152276 | A | 10/1920 |
| GB | 811665 | A | 4/1959 |
| GB | 1387571 | A * | 3/1975 |
| JP | 6-84167 | | 12/1994 |
| JP | 2000-055574 | | 2/2000 |
| JP | 2004-144366 | A | 5/2004 |
| JP | 2007-278688 | A | 10/2007 |
| JP | 2007-333319 | A | 12/2007 |
| JP | 2012-072936 | | 4/2012 |
| KR | 10-1999-0076959 | A | 10/1999 |
| KR | 10-2001-0029372 | A | 4/2001 |
| KR | 10-0353334 | | 2/2003 |
| KR | 10-2004-0111678 | A | 12/2004 |
| KR | 10-2007-0094792 | A | 9/2007 |
| KR | 10-2009-0095253 | | 9/2009 |
| KR | 10-2011-0088913 | A | 8/2011 |
| KR | 10-2011-0128709 | | 11/2011 |
| WO | WO 88/01362 | | 2/1988 |
| WO | WO 03/023306 | | 3/2003 |
| WO | WO 03/087677 | | 10/2003 |
| WO | WO 2006/105605 | A1 | 10/2006 |

OTHER PUBLICATIONS

Korean Office Action dated Aug. 30, 2013. (75636).
European Search Report dated May 13, 2014 issued in Application No. 14 151 438.0.
European Search Report dated May 13, 2014 issued in Application No. 13 193 106.5.
Korean Office Action dated May 30, 2014 issued in Application No. 10-2013-0011836.
Korean Office Action dated May 30, 2014 issued in Application No. 10-2013-0011837.
Korean Office Action dated May 30, 2014 issued in Application No. 10-2013-0011838.
Korean Office Action dated May 30, 2014 issued in Application No. 10-2013-0011839.
European Search Report dated Sep. 24, 2013.
European Search Report dated Nov. 21, 2014. (Full English Text).
Korean Office Action dated Dec. 26, 2014.
European Search Report dated Dec. 11, 2014. (Full English Text).
U.S. Office Action dated Jun. 4, 2015 issued in co-pending U.S. Appl. No. 13/895,542.

* cited by examiner

SUPPORT MECHANISM FOR A HEAT EXCHANGER IN AN AIR-CONDITIONING SYSTEM

CROSS-REFERENCE TO RELATED APPLICATION(S)

This application claims priority under 35 U.S.C. §119 to Korean Application No. 10-2012-0075633, filed in Korea on Jul. 11, 2012, the entire disclosure of which is hereby incorporated by reference.

BACKGROUND

1. Field

A heat exchanger is disclosed herein.

2. Background

Heat exchangers are known. However, they suffer from various disadvantages.

BRIEF DESCRIPTION OF THE DRAWINGS

Embodiments will be described in detail with reference to the following drawings in which like reference numerals refer to like elements, wherein.

DETAILED DESCRIPTION

Figure 1:
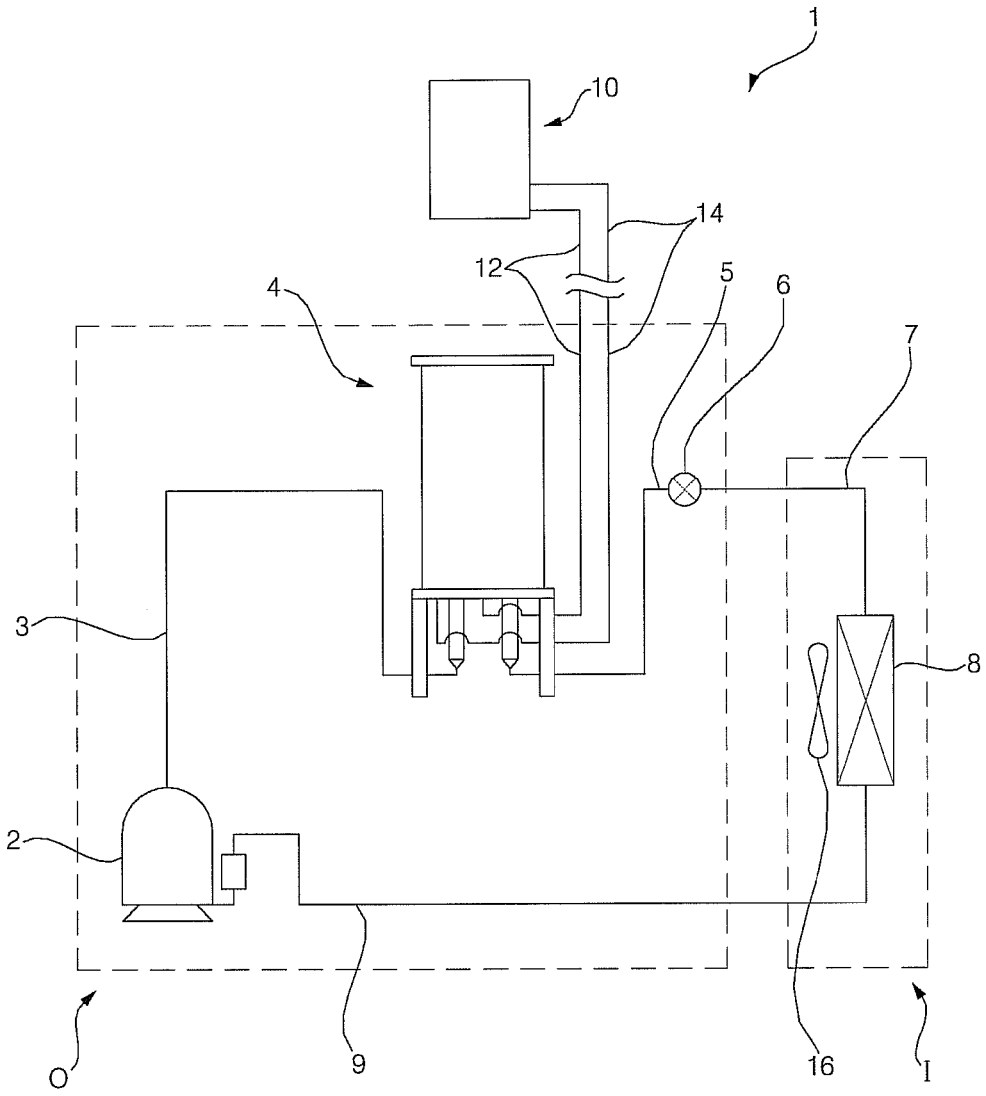
FIG. 1 is a schematic diagram of an air conditioner equipped with a heat exchanger according to an embodiment.

Hereinafter, embodiments will be described in detail with reference to the accompanying drawings. Where possible, like reference numerals have been used to indicate like elements, and repetitive disclosure has been omitted.

Heat exchangers are apparatuses that allow heat to transfer between two fluids and that are used for various purposes, such as cooling, heating, and supplying hot water. Heat exchangers may function as a waste heat recovery heat exchanger that recovers waste heat, a cooler that cools fluid at a high-temperature side, a heater that heats fluid at a low-temperature side, a condenser that condenses vapor, or an evaporator that evaporates fluid at a low-temperature side.

Various kinds of heat exchangers may be used, such as a fin-tube type heat exchanger having a tube, through which a first fluid flows, and fins formed on the tube; a shell-tube type air conditioner having a shell, through which a first fluid flows, and a tube, through which a second fluid that exchanges heat with the first fluid flows; a double tube type heat exchanger having an inner tube through which a first fluid flows and an outer tube, through which a second fluid that exchanges heat with the first fluid flows, that covers the inner tube; and a plate type heat exchanger in which a first fluid and a second fluid flow with a heat transfer plate therebetween.

A plurality of tubes may be disposed in the shell of the shell-tube type heat exchanger. The first fluid may be discharged outside through the shell after flowing into the shell, and the second fluid may pass through a plurality of tubes.

The first fluid may exchange heat with the second fluid passing through the plurality of tubes in the shell. The shell may be disposed to be horizontally long or extend horizontally, and the tubes may be disposed to be horizontally long or extend horizontally in the shell. A support that supports the shell may be provided, and a plurality of shells may support the shell at predetermined distances.

FIG. 1 is a schematic diagram of an air conditioner equipped with a heat exchanger according to an embodiment. The air conditioner 1 of FIG. 1 may include a compressor 2, a first heat exchanger 4, an expansion device 6, and a second heat exchanger 8. The first heat exchanger 4 may allow heat exchange between a first fluid and a second fluid. The first fluid may function as a cooling fluid that absorbs heat of the second fluid or a heating fluid that transfers heat to the second fluid. The air conditioner 1 may include the compressor 2, which compresses the second fluid; the first heat exchanger 4, through which the second fluid exchanges heat with the first fluid; the expansion device 6, which expands the second fluid, and the second heat exchanger 8, through which the second fluid exchanges heat with air.

The second fluid may sequentially pass through the compressor 2, the first heat exchanger 4, the expansion device 6, and the second heat exchanger 8. That is, the second fluid compressed by the compressor 2 may return to the compressor 2 after sequentially passing through the first heat exchanger 4, the expansion device 6, and the second heat exchanger 8. In this process, the first heat exchanger 4 may function as a condenser that condenses the second fluid, the second heat exchanger 8 may function as an evaporator that evaporates the second fluid, and the first fluid may function as a cooling fluid that absorbs the heat of the second fluid compressed by the compressor 2.

Alternatively, the second fluid may sequentially pass through the compressor 2, the second heat exchanger 8, the expansion device 6, and the first heat exchanger 4. That is, the second fluid compressed by the compressor 2 may return to the compressor 2 after sequentially passing through the second heat exchanger 8, the expansion device 6, and the first heat exchanger 4. In this process, the second heat exchanger 8 may function as a condenser that condenses the second fluid, the first heat exchanger 4 may function as an evaporator that evaporates the second fluid, and the first fluid may function as a heating fluid that transfers heat to the second fluid passing through the first heat exchanger 4.

The air conditioner 1 may further include a flow path selector (not shown), such as a valve, that allows the second fluid compressed by the compressor 2 to flow to the first heat exchanger 4 or the second heat exchanger 8. The air conditioner 1 may include a first circuit through which the second fluid compressed by the compressor 2 returns to the compressor 2 after sequentially passing through the flow path selector, the first heat exchanger 4, the expansion device 6, the second heat exchanger 8, and the flow path selector. The air conditioner 1 may include a second circuit through which the second fluid compressed by the compressor 2 returns to the compressor 2 after sequentially passing through the flow path selector, the second heat exchanger 8, the expansion device 6, the first heat exchanger 4, and the flow path selector. The first circuit may be a circuit for a cooling operation by which a room may be cooled by the second heat exchanger 8, the first heat exchanger 4 may function as a condenser that condenses the second fluid, and the second heat exchanger 8 may function as an evaporator that evaporates the second fluid. The second circuit may be a circuit for a heating operation by which a room is heated by the second heat exchanger 8, the second heat exchanger 8 may function as a condenser that condenses the second fluid, and the first heat exchanger 4 may function as an evaporator that evaporates the second fluid.

The first fluid may be liquid-state fluid, such as water or antifreeze, and the second fluid may be various kinds of refrigerants, such as a Freon-based refrigerant or a carbon dioxide refrigerant generally used for air conditioners.

The compressor 2 may be a compressor that compresses the second fluid, such as a rotary compressor, a scroll compressor, or a screw compressor. The compressor 2 may be connected with the first heat exchanger 4 by a compressor outlet channel 3.

The first heat exchanger 4 may be a shell-tube type heat exchanger. The first heat exchanger 4 may include a shell, through which the first fluid may pass, and a tube, through which the second fluid may pass. The first heat exchanger 4 may be connected with the expansion device 6 by a first heat exchanger-expansion device connection channel 5. The first heat exchanger 4 will be described in detail herein below.

The expansion device 6 may be a capillary tube or an electronic expansion valve through which the second fluid may expand. The expansion device 6 may be connected with the second heat exchanger 8 by an expansion device-second heat exchanger connection channel 7.

The second heat exchanger 8 may be a fin-tube type heat exchanger or a coil type heat exchanger through which the second fluid may pass. The second heat exchanger 8 may include a tube, through which the second fluid may exchange heat with indoor air. The second heat exchanger 8 may further include fins, which function as heat transfer members, coupled to the tube. The second heat exchanger 8 may be connected with the compressor 2 by a compressor intake channel 9.

The air conditioner 1 may further include a heat treatment device 10 connected with the first heat exchanger 4. The heat treatment device 10 may function as a cooler that cools the first fluid, when the first heat exchanger 4 functions as a condenser that condenses the second fluid. Alternatively, the heat treatment device 10 may function as a heater that heats the first fluid, when the first heat exchanger 4 functions as an evaporator that evaporates the second fluid. When functioning as a cooler, the heat treatment device 10 may include a cooling tower that cools the first fluid. The first fluid may be a cooling fluid, such as water or antifreeze, and the heat treatment device 10 may be connected with the first heat exchanger 4 by water discharge pipe 12 and water intake pipe 14. The first heat exchanger 4 may be connected with the heat treatment device 10 by the water discharge pipe 12, and the first fluid in the first heat exchanger 4 may be discharged to the heat treatment device 10 through the water discharge pipe 12. The first heat exchanger 4 may be connected with the heat treatment device 10 by the water intake pipe 14, and the first fluid in the heat treatment device 10 may enter the first heat exchanger 4 through the water intake pipe 14. A circulating mechanism, such as a pump, that circulates the first fluid to the heat treatment device 10 and the first heat exchanger 4 may be disposed in at least one of the heat treatment device 10, the water discharge pipe 12, or the water intake pipe 14.

The air conditioner 1 may further include an indoor fan 16 that returns indoor air to a room through the second heat exchanger 8.

The compressor 2, the first heat exchanger 4, the expansion device 6, the second heat exchanger 8, and the indoor fan 16 may constitute an air-conditioning device. Air in a room may cool or heat the room by flowing to the second heat exchanger 8 through, for example, a duct, and may then be discharged to the room through, for example, a duct. The heat treatment device 10 may be disposed not in the air-conditioning device, but outside of the air-conditioning device and connected with the air-conditioning device by the water discharge pipe 12 and water intake pipe 14.

The compressor 2, the first heat exchanger 4, the expansion device 6, the second heat exchanger 8, and the indoor fan 16 may be distributed in a plurality of air-conditioning devices I and O. The first heat exchanger 4 and the indoor fan 16 may be disposed together in an indoor device I, and the compressor 2 and the first heat exchanger 4 may be disposed together in a compression device O (or outdoor device).

The expansion device 6 may be disposed in at least one of the indoor device I or the compression device O. For the expansion device 6, one expansion device may be disposed in the indoor device I or the compression device O. Alternatively, a plurality of expansion devices 6 may be provided. A first expansion device may be disposed in the indoor device I, and a second expansion device may be disposed in the compression device O. The first expansion device may function as an outdoor expansion device, which is disposed closer to the first heat exchanger 4 than the second heat exchanger 8. The second expansion device may function as an indoor expansion device, which is disposed closer to the second heat exchanger 8 than the first heat exchanger 4.

The indoor device I may be disposed in a room to cool or heat the room. A plurality of indoor devices I may be connected with the compression device O. The compression device O may be installed at or in, for example, a machine room, a basement, or a roof of a building. The compression device O may be connected with the heat treatment device 10 by the water discharge pipe 12 and the water intake pipe 14.

The first heat exchanger 4 may be referred to as a heat exchanger in the following description.

Figure 2:
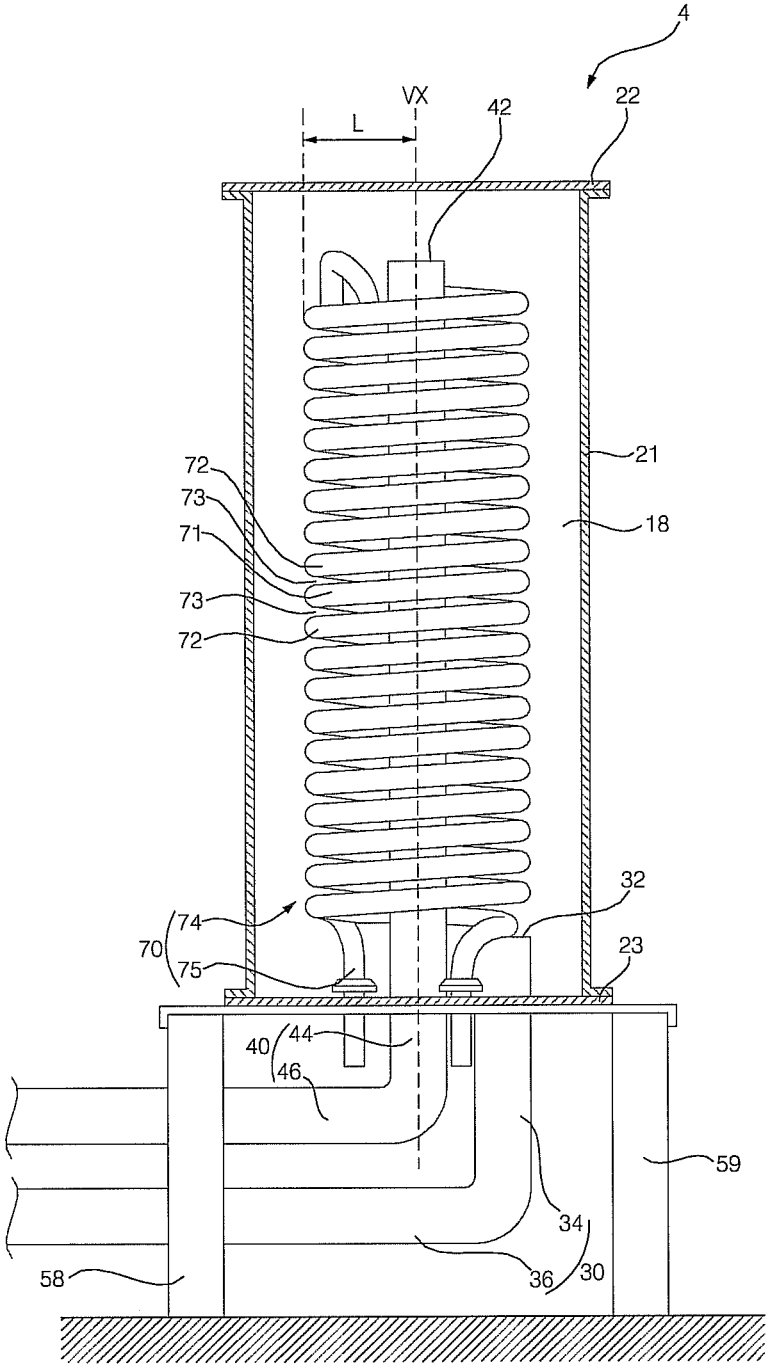
FIG. 2 is a side view showing an inside of a heat exchanger according to an embodiment.
Figure 3:
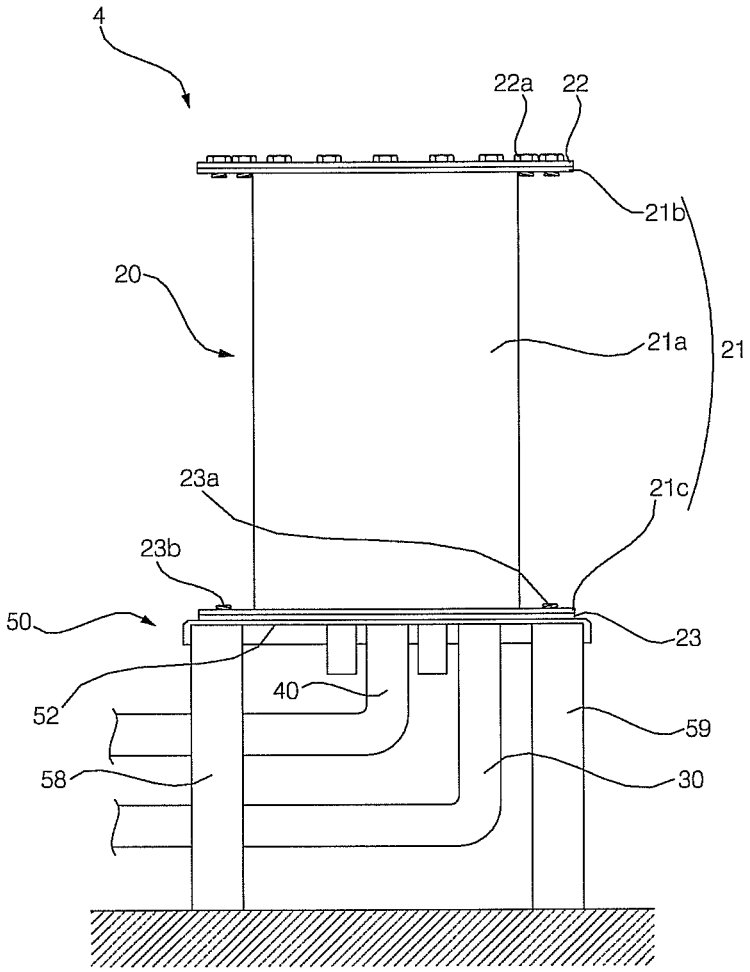
FIG. 3 is a side view showing an external appearance of a heat exchanger according to an embodiment.
Figure 4:
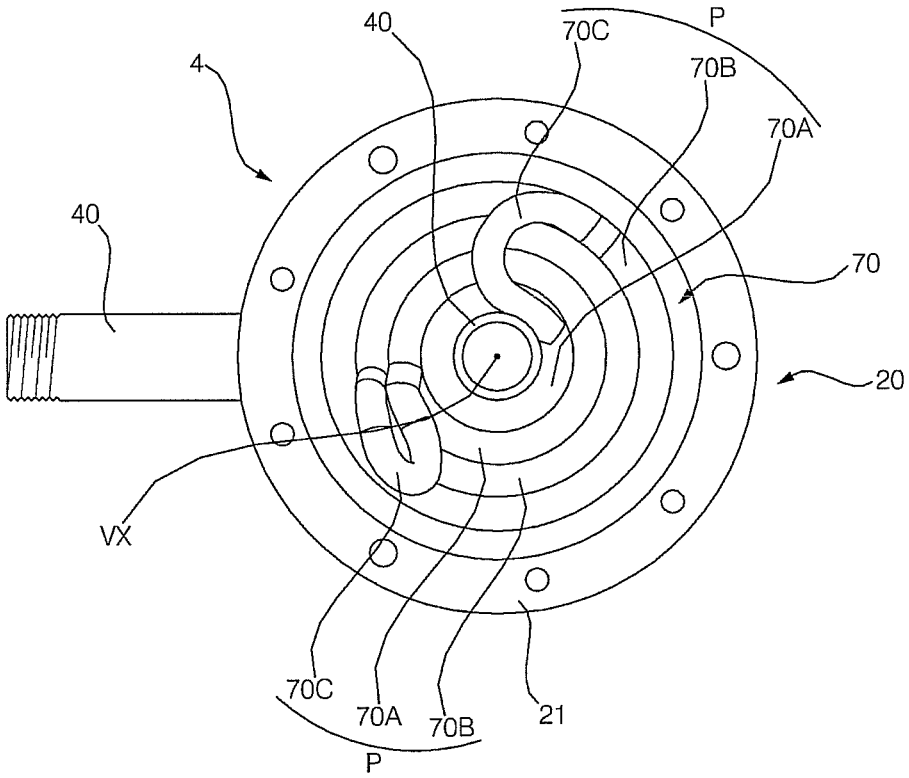
FIG. 4 is a plan view showing an inside of a heat exchanger according to an embodiment.
Figure 5:
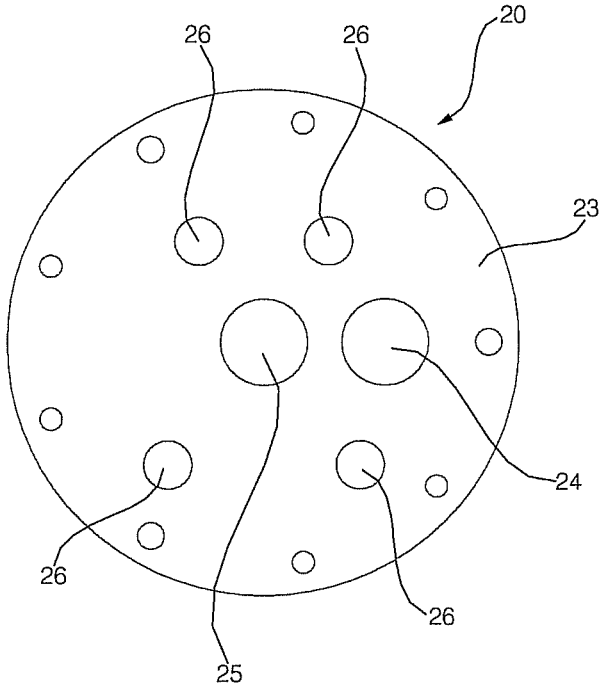
FIG. 5 is a bottom view of a shell of FIG. 2.
Figure 6:
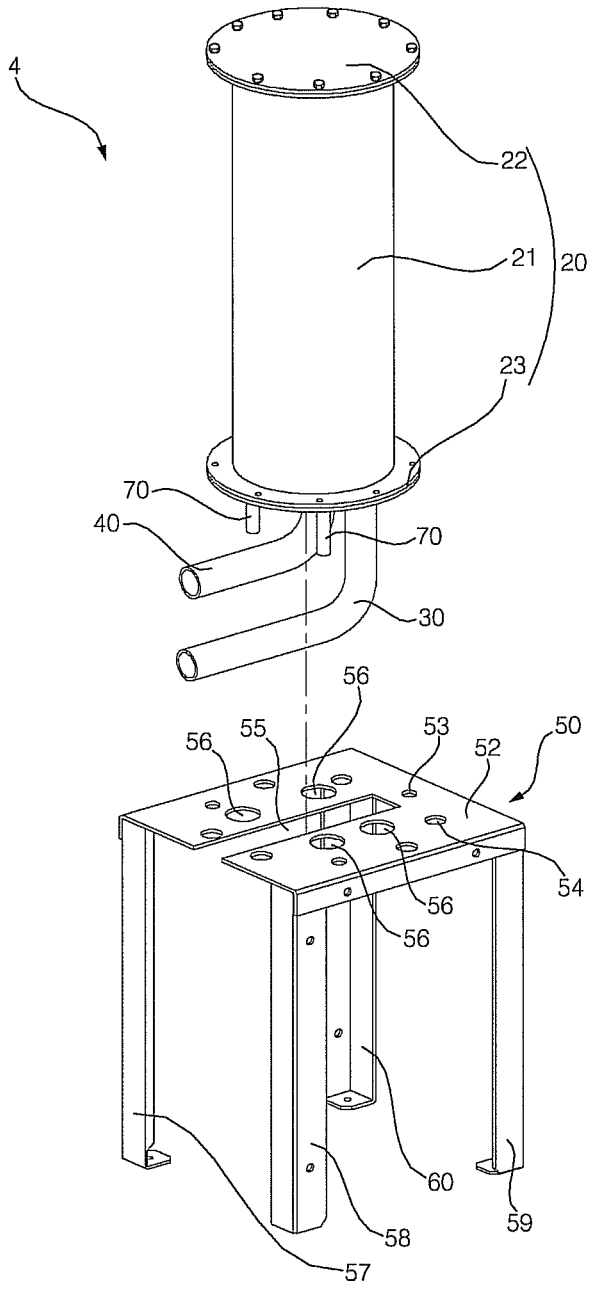
FIG. 6 is an exploded perspective view of the shell and a base of FIG. 2.

FIG. 2 is a side view showing an inside of a heat exchanger according to an embodiment. FIG. 3 is a side view showing an external appearance of a heat exchanger according to an embodiment. FIG. 4 is a plan view showing an inside of a heat exchanger according to an embodiment. FIG. 5 is a bottom view of a shell of FIG. 2. FIG. 6 is an exploded perspective view of the shell and a base of FIG. 2.

The heat exchanger 4 may include a shell 20, a first pipe 30 that guides the first fluid into the shell 20, a second pipe 40 through which the first fluid is guided outside of the shell 20, and a tube 70, through which the second fluid, which exchanges heat with the first fluid, may pass. The first fluid may flow into the shell 20 through the first pipe 30. The first fluid may exchange heat with the tube 70 while flowing in the shell 20. The first fluid may be discharged outside of the shell 20 through the second pipe 40. The second fluid may exchange heat with the first fluid when passing through a portion of the tube 70 positioned in the shell 20.

A space 18 may be defined in the shell 20. The first fluid may flow in the space 18 and at least a portion of the tube 70 may be received in the space 18. The shell 20 may include a case 21, an upper cover 22 coupled to a top of the case 21, and a lower cover 23 coupled to a bottom of the case 21. The case 21 may be disposed to be vertically long or extend vertically. The case 21 may be manufactured separately from the upper cover 22 and the lower cover 23, and may then be combined with the upper cover 22 and the lower cover 23, without being integrally formed with at least one of the upper cover 22 or the lower cover 23. When the case 21, the upper cover 22, and the lower cover 23 are separately manufactured and then combined, an inner circumferential surface of the case 21, an underside of the upper cover 22, and a top of the lower cover 23 may be easily coated with a coating fluid. When an inside of the shell 20 is coated, where the case 21 is integrally formed with one of the upper cover 22 or the lower cover 23, the coating fluid may not be uniformly spread on an inner wall of the case 21. In contrast, when the case 21, the upper cover 22, and the lower cover 23 are separately manufactured, the coating fluid may be uniformly spread on the inner wall of the case 21. The shell 20, the case 21, the upper cover 22, and the lower cover 23 may be combined, after the inner circumferential surface of the case 21, the underside of the upper case 22, and the top of the lower cover 23 are coated.

The case 21 may have a hollow body 21*a* with the space 18 therein, a first connecting portion 21*b* configured to be coupled with the upper cover 22, and a second connecting portion 21*c* configured to be coupled with the lower cover 23. The hollow body 21*a* may be formed in a hollow cylindrical shape. The first connecting portion 21*b* may protrude in a flange shape from an upper end of the hollow body 21*a*. The first connecting portion 21*b* may have fastening holes to fasten to the upper cover 22 by fasteners 22*a*, such as bolts. Threads for thread-fastening of the fasteners 22*a*, such as bolts, may be formed in the fastening holes of the first connecting portion 21*b*. The second connecting portion 21*c* may protrude in a flange shape from a lower end of the hollow body 21*a*. The second connecting portion 21*c* may have fastening holes to fasten to the lower cover 23 by fasteners 23*a* and 23*b*, such as bolts. Threads for thread-fastening of the fasteners 23*a* and 23*b*, such as bolts, may be formed in the fastening holes of the second connecting portion 21*c*.

The upper cover 22 may be, for example, a plate. That is, the upper cover 22 may be formed in a circular plate shape. Through-holes corresponding to the fastening holes of the first connecting portion 21*b* may be formed in the upper cover 22. The fastening members 22*a*, such as bolts, may be fastened to the first connecting portion 21*b* through the through-holes of the upper cover 22, and the upper cover 22 may be combined with the case 21.

The lower cover 23 may be, for example, a plate. That is, the lower cover 23 may be formed in a circular plate shape. Through-holes corresponding to the fastening holes of the second connecting portion 21*c* may be formed in the lower cover 23. The fastening members 23*a* and 23*b*, such as bolts, may be fastened to the second connecting portion 21*c* through the through-holes of the lower cover 23, and the lower cover 23 may be combined with the case 21.

A first pipe through-hole 24, through which the first pipe 30 may pass, may be formed in the shell 20. A second pipe through-hole 25, through which the second pipe may 40 pass, may be formed in the shell 20. Tube through-holes 26, through which the tube 70 may pass, may be formed in the shell 20. A number of the tube through-holes 26 may be the same as a number of the tubes 70.

The first pipe 30 may pass through the shell 20, such that an exit end 32 through which the first fluid may come out from the first pipe 30, may be positioned in the shell 20. The first fluid flowing into the shell 20 through the first pipe 30 may fill up from the lower portion of the shell 20. The first pipe 30 may be disposed such that the exit end 32, through which the first fluid comes out, may be positioned at the lower portion in the shell 20. A portion of the first pipe 30, which may be positioned outside the shell 20, may be connected to the water intake pipe 14 shown in FIG. 1. At least a portion of a vertical portion 34 of the first pipe 30 may be positioned in the shell 20. The vertical portion 34 may be disposed to protrude outside of the shell 20 through the shell 20. The first pipe 30 may further include a horizontal portion 36 bent from the vertical portion 34. The horizontal portion 36 may be bent at a lower portion of the vertical portion 34. The horizontal portion 36 may be perpendicularly bent at a lower end of the vertical portion 34. The exit end 32 may be positioned at an upper end of the vertical portion 34, and the horizontal portion 36 may be connected to the water intake pipe 14, as shown in FIG. 1.

The second pipe 40 may pass through the shell 20, such that an inlet end 42, through which the first fluid may enter the second pipe 40, may be positioned in the shell 20. The second pipe 40 may be disposed such that the first fluid at the lower portion of the shell 20 is not discharged through the second pipe 40, but rather, the first fluid at an upper portion of the shell 20 may be discharged through the second pipe 40. The second pipe 40 may be disposed, such that the inlet end 42, into which the first fluid may flow, may be positioned at the upper portion of the shell 20. A portion of the second pipe 40, which is positioned outside of the shell 20, may be connected to the water discharge pipe 12 shown in FIG. 1. At least a portion of the vertical portion 44 of the second pipe 40 may be positioned in the shell 20. The vertical portion 44 may protrude outside of the shell 20 through the shell 20. The second pipe 40 may have a horizontal portion 46 bent from the vertical portion 44. The horizontal portion 46 may be bent at a lower portion of the vertical portion 44. The horizontal portion 46 may be perpendicularly bent at a lower end of the vertical portion 44. The inlet end 42 may be positioned at an upper end of the vertical portion 44, and the horizontal portion 46 may be connected to the water discharge pipe 12 shown in FIG. 1.

The first pipe 30 and the second pipe 40 may be disposed through at least one of the case 21, the upper cover 22, or the lower cover 23. The tube 70 may be disposed through at least one of the case 21, the upper cover 22, or the lower cover 23. When the first pipe 30, the second pipe 40, and the tube 70 are disposed through the lower cover 23, it is possible to easily clean the heat exchanger 4. With the heat exchanger 4, the upper cover 22 may be separated from the case 21, and the case 21 may be separated from the lower cover 23, with the first pipe 30, the second pipe 40, and the tube 70 fixed to the lower cover 23. A worker may easily clean the heat exchanger 4, with the upper cover 22 and the case 21 separated therefrom, and the first pipe 30, the second pipe 40, and the tube 70 fixed to the lower cover 23. The worker may clean the first pipe 30, the second pipe 40, and the tube 70 with cleaning tools, such as a cleaning brush, without separating the first pipe 30, the second pipe 40, and the tube 70 from the lower cover 23. Considering easiness of cleaning the heat exchanger 4, the first pipe 30, the second pipe 40, and the tube 70 may be disposed through the lower cover 23.

The heat exchanger 4 may include a base 50 that supports the shell 20. The base 50 may have a fastening portion 52, to which the shell 20 may be fastened. The fastening portion 52 may be formed in a plate shape. The fastening portion 52 may be horizontally disposed under the shell 20. The shell 20 may be placed on the fastening portion 52 or fastened to the fastening portion 52. The heat exchanger 4 may have a first fastening portion 23*a* that fastens the case 21, the lower cover 23, and the base 50, and a second fastening portion 23*b* that fastens the case 21 and the lower cover 23. First fastener through-holes 53, into which the first fasteners 23, may be inserted and second fastener-avoiding holes 54 to avoid the second fasteners 23*b* may be formed through the fastening portion 52. The second fastener-avoiding holes 54 may be formed larger than the first fastener through-holes 53. The second fastener-avoiding holes 54 may surround the second fasteners 23*b*. The first fasteners 23*a* may function as pressure-resistant fasteners that fasten the case 21 to the lower cover 23 and fasten the shell 20 to the base 50. The second fasteners 23*b* may function as fasteners that fasten the case 21 to the lower cover 23. In the heat exchanger 4, when only the first fasteners 23*a* and the second fasteners 23*b* are loosened, the shell 20 may be separated from the base 50, with the second fasteners 23*b* fastening the case 21 to the lower cover 23.

A pipe hole 55, through which at least one of the first pipe 30 or the second pipe 40 may pass, may be formed through the fastening portion 52. The pipe hole 55 of the fastening portion 52 may include a first fastening hole, through which the first pipe 30 may pass, and a second pipe hole, through which the second pipe 40 may pass. One pipe hole 55 may be formed at the fastening portion 52, and the first pipe 30 and the second pipe 40 may pass together through the pipe hole 55. When the pipe hole 55 is formed at the fastening portion 52, the pipe hole 55 may be formed to be horizontally long or extend horizontally. The pipe hole 55 may be formed to be open at one side of the fastening portion 52. The pipe hole 55 may be formed such that a lower portion of the first pipe through-hole 24 and a lower portion of the second pipe through-hole 25 are vertically open. The pipe hole 55 may be formed larger than a sum of a size of the first pipe through-hole 24 and a size of the second pipe through-hole 25. Tube holes 56, through which the tube 70 may pass, may be formed in the fastening portion 52.

The base 50 may have a support portion that supports the fastening portion 52. The support portion may include a plurality of legs 57, 58, 59, and 60 disposed under the fastening portion 52. The legs 57, 58, 59, and 60 may be disposed to be spaced from each other.

The tube 70 may spirally wind several times and a gap 73 may be defined between a plurality of turns 71 and 72. That is, the tube 70 may be a spiral tube having a coil shape. The tube 70 may have the spiral portion 74 having a plurality of turns 71 and 72. The tube 70 may be formed such that the plurality of turns 71 and 72 have a vertical central axis VX. The plurality of turns 71 and 72 may be wound such that a distances L from the vertical central axis VX are the same. The spiral portion 74 may have at least ten or more turns. The spiral portion 74 may be wound continuously and spiral clockwise or counterclockwise. The plurality of turns 71 and 72 may be vertically spaced from each other, and the gap 73 may be defined between the plurality of turns 71 and 72. The first fluid may flow into the space in the spiral portion 74 from the space between the shell 20 and the spiral portion 74 through the gap 73, or may flow into the space between the shell 20 and the spiral portion 74 from the space in the spiral portion 74 through the gap 73. The spiral portion 74 may be positioned between the second pipe 40 and the shell 20.

The tube 70 may have a vertical portion 75 that extends from the spiral portion 74 in a straight pipe shape. The vertical portion 75 may be bent at an uppermost turn of the spiral portion 74. The vertical portion 75 may be bent at a lowermost turn of the spiral portion 74. The vertical portion 75 may pass through the shell 20 and the tube hole 56, extending from a lower end of the spiral portion 74. The vertical portion 74 may be disposed substantially in parallel with the vertical central axis VX.

One tube 70 may be disposed in the shell 20 or a plurality of tubes 70 may be disposed in the shell 20. When one tube 70 is disposed in the shell 20, a first straight portion, through which the second fluid may be guided to the spiral portion 74, may be formed at one end of the spiral portion 74, and a second straight portion, through which the second fluid may pass through the spiral portion 74, may be formed at the other end of the spiral portion 74.

When a plurality of tubes 70A and 70B are disposed in the shell 20, the tubes 70A and 70B may be disposed to have the same vertical central axis VX. Further, a pair of tubes 70A and 70B having different distances from the vertical central axis VX may be connected in series. Such a pair of tubes 70A and 70B having different distances from the vertical central axis VX may be connected by one or more connection tube 70C. The connection tube(s) 70C may be formed in a U-shape. The pair of tubes 70A and 70B and the connection tube(s) 70C may constitute one heat transfer tube P. The second fluid may flow to the connection tube 70C after sequentially passing through the vertical portion 75, and the spiral portion 74 of any one of the pair of tubes 70A and 70B, and then, may flow outside of the shell 20 after sequentially passing through the spiral portion 74 and the vertical portion 75 of the other one of the pair of tubes 70A and 70B. The second fluid may exchange heat with the first fluid while passing through any one of the pair of tubes 70A and 70B, exchange heat with the first fluid while passing through the connection tube 70C, and then exchange heat with the first fluid while passing through the other one of the pair of tubes 70A and 70B.

When a plurality of tubes 70 is disposed in the shell 20, a tube closest to the second pipe 40 may be fixed in contact with the second pipe 40 and a tube closest to the shell 20 may not be in contact with the shell 20. When a plurality of tubes 70 is disposed in the shell 20, an innermost tube may be disposed to surround the second pipe 40 in contact with the second pipe 40, and may be fixed by the second pipe 40. When a plurality of tubes 70 is disposed in the shell 20, an outermost tube may be spaced from an inner side of the shell 20.

With the heat exchanger 4, when the shell 20 is placed on the fastening portion 52, a portion of the first pipe 30, a portion of the second pipe 40, and a portion of the tube 70 may be positioned under the fastening portion 52. The first pipe 30, the second pipe 40, and the tube 70 may extend under the shell 20. The first pipe through-hole 24, through which the first pipe 30 may pass, and the second pipe through-hole 25, through which the second pipe 40 may pass, may be formed at a predetermined distance in the lower cover 23. Tube through-holes 26, through which the tube 70 may pass, may be formed in the lower cover 23. The tube through-holes 26 may be spaced from the first pipe through-hole 24 and the second pipe through-hole 25. The first pipe through-hole 24 and the second pipe through-hole 25 may be positioned above the pipe hole 55. The tube through-holes 26 may be positioned above the tube hole 56. The vertical portion 36 of the first pipe 30, the vertical portion 46 of the second pipe 40, and the vertical portion 75 of the tube 70 may pass through the lower cover 23.

The vertical portion 34 of the first pipe 30 may pass through the first pipe through-hole 24 of the lower cover 23, and the pipe hole 55 of the fastening portion 52 and the horizontal portion 36 may be disposed under the fastening portion 52 and pass through between the legs 57 and 58. The first pipe 30 may be installed together with the shell 20 while being fixed to the shell 20, and the horizontal portion 34 may be positioned under the pipe hole 55 through the pipe hole 55 of the fastening portion 52, when the shell 20 is placed on the fastening portion 52. The horizontal portion 34 may be disposed through the legs 57 and 58, when being positioned under the pipe hole 55.

The vertical portion 44 of the second pipe 40 may pass through the second pipe through-hole 25 of the lower cover 23, and the pipe hole 55 of the fastening portion 52 and the horizontal portion 46 may be disposed under the fastening portion 52 and pass through between the legs 57 and 58. The second pipe 40 may be installed together with the shell 20 while being fixed to the shell 20, and the horizontal portion 44 may be positioned under the pipe hole 55 through the pipe hole 55 of the fastening portion 52, when the shell 20 is placed on the fastening portion 52. The horizontal portion 44 may be disposed through the legs 57 and 58, when being positioned under the pipe hole 55.

The vertical portion 75 of the tube 70 may pass through the tube through-hole 26 of the lower cover 23 and through the tube hole 56 of the fastening portion 52. The lower end of the vertical portion 75 may be positioned under the tube hole 56. The tube 70 may be installed together with the shell 20 while being fixed to the shell 20, and the lower end of the vertical portion 75 may be positioned under the pipe hole 56 of the fastening portion 52, through the pipe hole 56.

Related art heat exchangers have a problem in that they occupy a large installation space, and there are too many supports because the supports are attached to lower portions of both sides of the shell, and the cooling water inlet and cooling water outlet may be easily damaged, in addition to the intake port and the discharge port.

Embodiments disclosed herein provide a heat exchanger that may include a shell; a first pipe that guides first fluid into the shell; a tube, through which the second fluid that exchanges heat with the first fluid passes; a second pipe, through which the first fluid is guided outside of the shell; and a base that supports a fastening portion to which the shell is fastened and a support portion that supports the fastening portion. The fastening portion may have a tube hole, through which the tube may pass, and a pipe hole, through which at least one of the first pipe or the second pipe may pass. The support portion may include a plurality of legs disposed under the fastening portion and spaced from each other.

Each of the first pipe and the second pipe may have a horizontal portion positioned under the fastening portion, and the horizontal portions may pass through between the legs. The first pipe and the second pipe both may pass through the pipe hole. The pipe hole may be formed to be horizontally long or extend horizontally in the fastening portion. The pipe hole may be formed to be at one side of the fastening portion.

The shell may include a case; an upper cover coupled to a top of the case; and a lower cover coupled to an underside of the case, in which the first pipe and the second pipe pass through the lower cover. The first pipe, the second pipe, and the tube each may have a vertical portion passing through the lower cover.

A first pipe through-hole, through which the first pipe may pass, and a second pipe through-hole, through which the second pipe may pass, may be formed in the lower cover. The first pipe through-hole and the second pipe through-hole may be positioned above the pipe hole. A size of the pipe hole may be larger than a size of the first pipe through-hole and a size of the second pipe through-hole.

The heat exchanger may further include first fasteners that fasten the case, the lower cover, and the base, and second fasteners that fasten the case and the lower cover. First fastener through-holes, through which the first fasteners may pass, and second fastener-avoiding holes to avoid the second fasteners may be formed in the fastening portion. The second fastener-avoiding holes may be larger in size than the first fastener through-holes.

The tube may have a spiral portion positioned between the second pipe and the shell, which maybe spirally wound several times.

The tube may have a vertical portion extending from a lower end of the spiral portion and passing through the shell and the tube hole, and a lower end of the vertical portion may be positioned under the tube hole.

Embodiments disclosed herein have an advantage in that as at least one of the first pipe, the second pipe, or the tube may extend under the shell, it is possible to increase availability of spaces at a side of and above the shell, and at least one of the first pipe, the second pipe, or the tube may be protected by the base, resulting in high reliability.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A support mechanism for a heat exchange in an air-conditioning system, comprising:

a shell;

a first pipe that guides a first fluid into the shell;

a tube, through which a second fluid, which exchanges heat with the first fluid, passes;

a second pipe, through which the first fluid is guided outside of the shell; and a base including a fastening portion to which the shell is fastened and a support portion that supports the fastening portion, wherein the fastening portion has a tube hole through which the tube passes and a pipe slot through which at least one of the first pipe or the second pipe passes, wherein each of the first pipe and the second pipe has a vertical portion that extends in a vertical direction with respect to the shell, wherein both of the vertical portions of the first pipe and the second pipe pass through the pipe slot in the vertical direction with respect to the fastening portion, and wherein the pipe slot extends in a horizontal direction with respect to the fastening portion and is open at one side of the fastening portion such that both of rte vertical portions of the first pipe and the second pipe are inserted into the pipe slot in the horizontal direction.

2. The support mechanism of claim 1, wherein the support portion includes a plurality of legs provided under the fastening portion and spaced from each other.

3. The support mechanism of claim 2, wherein each of the first pipe and the second pipe includes a horizontal portion positioned under the fastening portion.

4. The support mechanism of claim 1, wherein the shell includes:

a case;

an upper cover coupled to a top of the case; and a lower cover coupled to an underside of the case, wherein the first pipe and the second pipe pass through the lower cover.

5. The support mechanism of claim 4, the tube has a vertical portion that passes through the lower cover.

6. The support mechanism of claim 4, wherein a first pipe through-hole, through which the first pipe passes, and a second pipe through-hole, through which the second pipe passes, are formed in the lower cover, and wherein the first pipe through-hole and the second pipe through-hole are positioned above the pipe slot.

7. The support mechanism of claim 6, wherein a length of the pipe slot is larger than a sum of a diameter of the first pipe through-hole and a diameter of the second pipe through-hole.

8. The support mechanism of claim 4, further including:

first fasteners that fasten the case, the lower cover, and the base; and second fasteners that fasten the case and the lower cover.

9. The support mechanism of claim 8, wherein first fastener through-holes, through which the first fasteners pass, and second fastener-avoiding holes to avoid the second fasteners are formed in the fastening portion.

10. The support mechanism of claim 9, wherein the second fastener-avoiding holes are larger in size than the first fastener through-holes.

11. The support mechanism of claim 1, wherein the tube has a spiral portion positioned between the second pipe and the shell and spirally wound a plurality of times.

12. The support mechanism of claim 11, wherein the tube has a vertical portion that extends from a lower end of the spiral portion and passes through the shell and the tube hole, and wherein a lower end of the vertical portion is positioned under the tube hole.

13. An air conditioner including the support mechanism of claim 1.

14. A support mechanism for a heat exchanger in an air-conditioning system, comprising:

a shell;

a first pipe that guides a first fluid into the shell;

a tube, through which a second fluid, which exchanges heat with the first fluid, passes;

a second pipe, through which the first fluid is guided outside of the shell; and a base including a fastening portion to which the shell is fastened and a support portion that supports the fastening portion, wherein the fastening portion has a tube hole through which the tube passes and a pipe slot through which at least one of the first pipe or the second pipe passes, wherein the support portion includes a plurality of leg provided under the fastening portion and spaced from each other, and wherein each of the first pipe and the second pipe includes a horizontal portion positioned under the fastening portion, and a vertical portion that extends in a vertical direction with respect to the shell, wherein both of the vertical portions of the first pipe and the second pipe pass through the pipe slot in the vertical direction with respect to the fastening portion, and wherein the pipe slot extends in a horizontal direction with respect to the fastening portion and is open at one side of the Fastening portion such that both of the vertical portions of the first pipe and the second pipe are inserted into the pipe slot in the horizontal direction.

15. The support mechanism of claim 14, wherein the shell includes:

a case;

an upper cover coupled to a top of the case; and a lower cover coupled to an underside of the case, wherein the first pipe and the second pipe pass through the lower cover.

16. The support mechanism of claim 15, wherein the tube has a vertical portion that passes through the lower cover.

17. The support mechanism of claim 15, wherein a first pipe through-hole, through which the first pipe passes, and a second pipe through-hole, through which the second pipe passes, are formed in the lower cover, and wherein the first pipe through-hole and the second pipe through-hole are positioned above the pipe slot.

18. The support mechanism of claim 17, wherein a length of the pipe slot is greater than sum of a diameter of the first pipe through-hole and a diameter of the second pipe through-hole.

19. An air conditioner including the support mechanism of claim 14.

* * * * *